US006836072B2

(12) United States Patent
Byrum et al.

(10) Patent No.: US 6,836,072 B2
(45) Date of Patent: Dec. 28, 2004

(54) LOW VOLTAGE HIGH EFFICIENCY ILLUMINATED DISPLAY HAVING CAPACITIVE COUPLED ELECTRODES

(75) Inventors: Bernard W. Byrum, Perrysburg, OH (US); Robert E. Carter, II, Toledo, OH (US); Weiguo Wang, Toledo, OH (US)

(73) Assignee: Electro Plasma, Inc., Millbury, OH (US)

( * ) Notice: Subject to any disclaimer, the term of this patent is extended or adjusted under 35 U.S.C. 154(b) by 368 days.

(21) Appl. No.: 10/001,100

(22) Filed: Nov. 2, 2001

(65) Prior Publication Data

US 2004/0100180 A1 May 27, 2004

(51) Int. Cl.[7] ..... H01J 61/32
(52) U.S. Cl. ..... 313/634; 313/483; 313/491
(58) Field of Search ..... 313/483, 491, 313/582–587, 632, 634, 635, 493, 636, 484, 607, 234

(56) References Cited

U.S. PATENT DOCUMENTS

| | | | | |
|---|---|---|---|---|
| 1,743,569 | A | | 1/1930 | Purdom |
| 1,825,399 | A | | 9/1931 | Hotchner |
| 2,102,049 | A | | 12/1937 | Warren |
| 2,761,087 | A | | 8/1956 | Bowtell |
| 2,852,877 | A | | 9/1958 | Goebel et al. |
| 3,629,638 | A | | 12/1971 | Veron |
| 3,778,127 | A | | 12/1973 | Langston, Jr. et al. |
| 4,584,501 | A | | 4/1986 | Cocks et al. |
| 4,618,802 | A | | 10/1986 | Schrank |
| 4,703,574 | A | | 11/1987 | Garjian |
| 4,740,729 | A | | 4/1988 | Chow |
| 4,780,644 | A | | 10/1988 | Sakai et al. |
| 4,786,841 | A | | 11/1988 | Fohl et al. |
| 4,839,555 | A | | 6/1989 | O'Mahoney |
| 4,872,741 | A | | 10/1989 | Dakin et al. |
| 4,887,003 | A | | 12/1989 | Parker |
| 4,931,685 | A | | 6/1990 | Dobashi et al. |
| 4,990,826 | A | | 2/1991 | Cocks et al. |
| 5,036,243 | A | | 7/1991 | Cocks et al. |
| 5,479,069 | A | | 12/1995 | Winsor |
| 5,479,071 | A | | 12/1995 | Lynn |
| 5,592,047 | A | * | 1/1997 | Park et al. ..... 313/484 |
| 5,767,618 | A | | 6/1998 | Maya et al. |
| 5,811,925 | A | | 9/1998 | Anandan et al. |
| 5,892,326 | A | | 4/1999 | Byrum et al. |
| 5,911,613 | A | | 6/1999 | Byrum et al. |
| 6,118,215 | A | | 9/2000 | Byrum et al. |
| 6,628,077 | B2 | * | 9/2003 | Shirozu ..... 313/587 |

* cited by examiner

*Primary Examiner*—Joseph Williams
(74) *Attorney, Agent, or Firm*—MacMillan, Sobanski & Todd, LLC

(57) ABSTRACT

A gas filled channel is formed between a pair of plates. A phosphor is disposed upon a surface of the channel and the channel is filled with a mixture of noble gases. A surface electrode is formed upon the exterior surface of each of the plates. Upon application of an alternating voltage to the pair of surface electrodes, the electrodes are capacitively coupled across the channel and break down the gas contained in the channel. The gasses emit ultraviolet light that causes the phosphor to emit visible light in a characteristic color.

29 Claims, 7 Drawing Sheets

LOW VOLTAGE HIGH EFFICIENCY ILLUMINATED DISPLAY HAVING CAPACITIVE COUPLED ELECTRODES

BACKGROUND OF THE INVENTION

This invention relates in general to luminous displays and in particular to a luminous display employing a gas discharge and a method of manufacturing such a display.

Luminous flat glass signs employing a gaseous discharge and methods for making such signs have been disclosed in several patents. In general, these flat glass signs are made by using two or three glass plates with a groove or cavity corresponding to the desired display formed in one or two of the plates. When three plates are used, the groove or cavity can be formed in the intermediate plate which is disposed between a pair of outer plates. Alternately, the intermediate plate can be omitted with the groove or cavity formed in an interior surface of one or both of the outer plates.

Referring now to the drawings, where like reference characters represent like elements, there is illustrated in FIG. 1, a typical prior art luminous gas discharge display 10. The luminous gas discharge display 10 includes a front plate 12 which is opposite to a back plate 14. The front and back plates 12 and 14 may be formed of most any suitable thickness and size to withstand temperatures and vacuum levels of gas discharge. At least the front plate 12 is formed of a transparent material such as glass or plastic or the like.

At least one of the plates 12 and 14 includes a channel 16 formed in an interior surface thereof. The channel 16 defines a gas discharge path and may be of most any suitable configuration or length. The channel 16 may be in the shape of a continuous tortuous path or in the shape of multiple independent paths configured to appear as a reference character such as letters or numbers. For illustrative purposes, the channel 16 is shown in FIG. 1 in the shape of the Greek letter "Ω". A sealing layer 17 is disposed between the plated 12 and 14 and forms a hermetic seal therebetween.

The display 10 further includes at least two electrodes 18 and 19 that are in direct contact with the gas within the channel 16. The electrodes 18 and 19 are of a conventional design and energize an ionizable gas which is contained within the channel 16. As illustrated in FIGS. 1, the electrodes 18 and 19 are located between the plates 12 and 14. Electricity to power the display 10 is supplied to the electrodes 18 and 19 by a transformer (not shown) through lead wires 20 and 21 as is well known in the art.

The channel 16 is filled with an ionizable gas, such as, for example, mercury, xenon, krypton, neon or argon, or mixtures of ionizable gases. A charging port 24, which comprises a glass tube extending through the back panel 14, communicates with the channel 16. After the display panel 10 has been assembled, any gases within the channel 16 are evacuated through the charging port 24 and then the channel 16 is refilled with a selected ionizable gas or mixture of such gases. Typically, the charging port 24 can be sealed by a "tip off" operation during which the glass tube is heated and stretched to pinch and separate the tube and thus form a seal. While the charging port 24 is illustrated as extending through the back plate 14, it also be appreciated that the invention can be practiced with the charging port 24 extending through the front plate 12 or an edge of the display 10.

To further enhance the display 10, a light emitting phosphor (not shown) can be applied to the interior surface of the front plate 12, to the interior surface of the back plate 14, or to the interior surface of the channel 16. When the display

10 includes a light emitting phosphor, a small amount of liquid mercury (Hg) is included in the channel. The natural vapor pressure of the Hg fills the channel 16 with Hg in its gaseous state. The resulting Hg vapor emits UV radiation when excited by the electrical discharge through the channel 16. The UV radiation excites the phosphor, causing the phosphor to emit a colored light. The color of the emitted light is determined by the particular phosphor utilized. The phosphor changes the light color of the display 10 as required to improve the aesthetics of the display.

During operation of the display 10, a longitudinal gas discharge is established between the electrodes 18 and 19 to form a long positive column discharge. Because of the length of the channel 16 a relatively high voltage, typically within the range of six to nine kilovolts, is required to be applied to the electrodes 18 and 19. Additionally, the mercury vapor within the channel 16 can be hazardous if accidentally released from the channel 16. Prior to the development of flat glass signs, illuminated displays typically used fragile glass tubes that were filled with a mixture of neon gas and mercury vapor. Accordingly, it would be desirable to provide a display that uses a lower electrode voltage and does not require Hg. Additionally, it also would be useful to increase the operating efficiency of the display.

SUMMARY OF THE INVENTION

This invention relates to a luminous display employing a gas discharge and a method of manufacturing such a display.

The present invention contemplates a light display that includes a first plate and a second plate, each of which has an interior surface and an exterior surface. The first plate is attached to the second plate by a seal with the interior surfaces of the plates facing one another. A cavity is disposed between the plates and a layer of phosphor is deposited upon an interior surface of one of the plates. A least one electrode in formed upon an exterior surface of one of the plates and a second electrode is formed upon a surface of the other of the plates. The cavity is filled with a gas mixture.

The invention further contemplates that the second electrode can be formed upon either an exterior or an interior surface of the other plate. Additionally, the gas mixture includes noble gases while excluding mercury.

Upon application of an alternating voltage to the electrodes, the gases within the channel break down and emit ultraviolet light. The ultraviolet light excites the atoms in the phosphor, causing the phosphor to emit a visible light in a color that is a characteristic of the particular phosphor.

The invention also contemplates a method for making a light display that includes the steps of providing a first plate and forming a continuous channel in a surface of the first plate. A phosphor is deposited within the channel and a second plate is attached to the first plate with the channel located between the first and second plates. A first surface electrode is applied to an exterior surface of the first plate and a second surface electrode is applied to an exterior surface of the second plate. The channel is then evacuated and subsequently charged with a mixture of noble gases.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
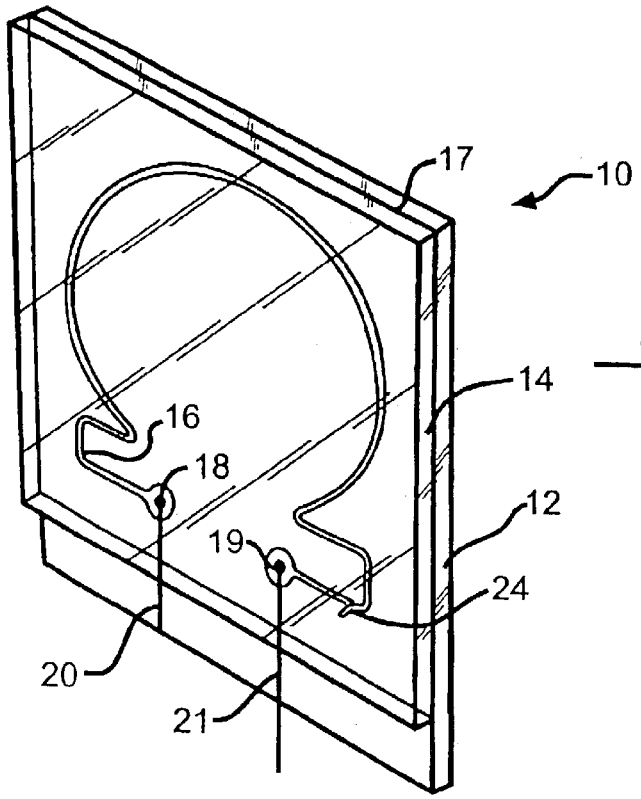
FIG. 1 (PRIOR ART)
FIG. 1 is an isometric view of a luminous gas discharge display in accordance with the prior art.
Figure 2:
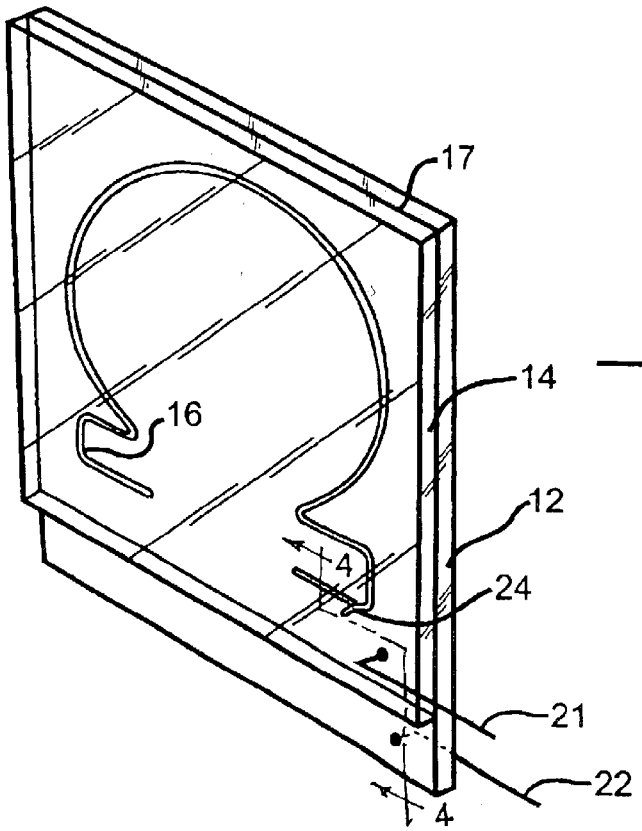
FIG. 2 is an isometric view of a luminous gas discharge display in accordance with the present invention.

Referring again to the drawings, there is illustrated in FIG. 2, an isometric view of a luminous gas discharge display 30 in accordance with the present invention. Components in FIG. 2 that are similar to components shown in FIG. 1 have the same numerical designator. In considering the figures, it will be appreciated that for purposes of clarity, certain details of construction are not provided in view of such details being conventional and well within the skill of the art once the invention is disclosed and explained.

Similar to the display 10 described above, the display 30 includes front and back plates 12 and 14 formed of most any suitable thickness and size to withstand processing temperatures and vacuum levels. At least the front plate 12 is formed of a transparent material such as glass or plastic or the like. The back plate 14 can be formed from a glass, plastic or ceramic. In a preferred embodiment, both the front and back plates 12 and 14 are formed of soda lime glass. In the preferred embodiment, the glass plates 12 and 14 contain at least ten percent soda by weight. The front and back plates 12 and 14 may be of the same thickness or of a different thickness.

A continuous channel 16 is formed in the interior surface of one or more of the plates 12 and 14 by any conventional means known in the art. For example, the channel 16 may be mechanically formed by sand blasting or mechanical routing. Alternately, the channel 16 may be formed by a chemical process, such as acid rotting. The channel 16 can be formed to any depth consistent with the glass thickness. Also, the width of the channel 16 can vary (not shown). In the preferred embodiment, mechanical routing is utilized to form the channel 16, as described in U.S. Pat. No. 5,911,613, which is incorporated herein by reference.

As in the prior art display 10 described above, the channel 16 defines a gas containment cavity that may be of most any suitable configuration or length. The channel 16 may be in the shape of a continuous tortuous path or in the shape of multiple independent paths configured to appear as a reference character such as letters or numbers. Similarly, the path may have a variable width to form a desired geometric or other shape. For illustrative purposes, the channel 16 is shown again in FIG. 2 in the shape of the Greek letter "Ω".

A transparent sealing layer 17 formed from an electrically insulative sealing material that is disposed between the front and back plates 12 and 14. The sealing layer 17, which can be either a total surface seal or a perimeter seal, joins the front plate 12 to the back plate 14 in a totally intimate manner such that the display 30 is effectively a single plate of glass. The sealing layer 17, which is typically a few thousands of an inch, or mils, thick, forms a hermetic seal between the front and back plates 12 and 14. The sealing layer 17 also can be applied between the plates 12 and 14 and adjacent to the edges of the channel 16 and extending a sufficient distance from the channel to form the seal.

Figure 3:
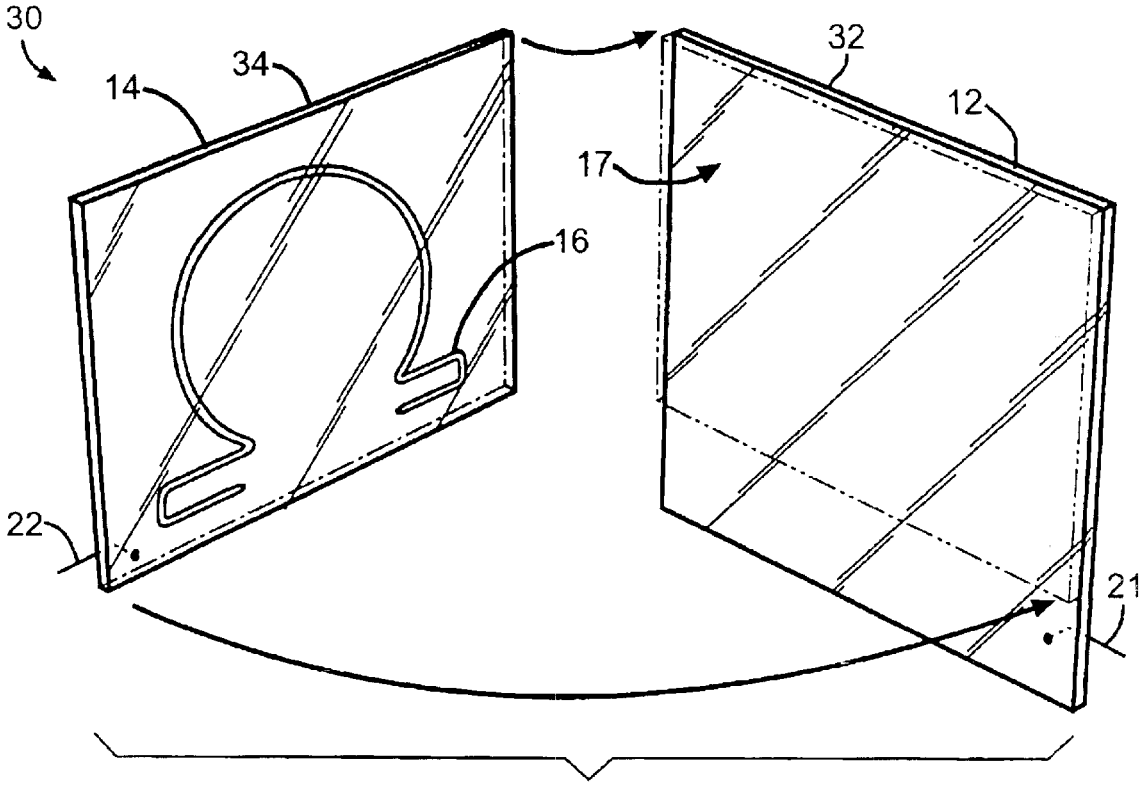
FIG. 3 is an exploded isometric view of the gas discharge display of FIG. 2.

In the preferred embodiment, the sealing layer 17 is formed from a sealing glass, such as solder glass. A solder glass layer 17 is formed from a glass frit having a high lead oxide content, such as a frit formed from lead-borate glass which has a lead content of approximately 75 percent by weight. The sealing layer 17 is formed by a conventional process, such as, for example, printing or spraying the sealing material onto one of the plates 12 and 14 or by forming a preform of the sealing material glass and placing the preform upon one of the plates or by Chemical Vapor Deposition (CVD) directly onto the surface of one of the plates. In the preferred embodiment, as shown in FIG. 3, the sealing material is applied to the interior surface of the front plate 12 while the channel 16 is formed in the interior surface of the back plate 14. Alternately, the sealing material could be applied to the interior surface of the back plate 14. However, application of the solder glass to the back plate 14 would require masking to prevent the sealing material from being applied to any surfaces of the channel 16.

Figure 4:
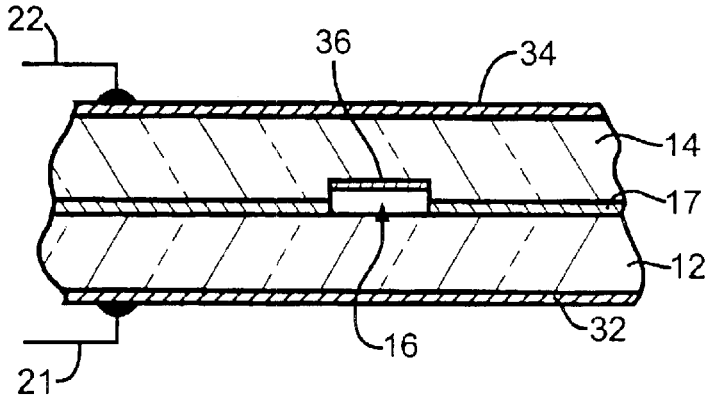
FIG. 4 is a fragmentary cross sectional view taken along line 4—4 in FIG. 2.

As best seen in FIG. 4, a pair of thin film surface electrodes 32 and 34 are deposited upon the exterior surfaces of the front and back plates 12 and 14, respectively. In one embodiment of the invention, each of the electrodes 32 and 34 extends completely over the surface of the corresponding plate, 12 and 14. The electrodes 32 and 34 are formed from a transparent, electrically conductive material, such as, for example, a doped tin oxide. In the preferred embodiment, the electrodes 32 and 34 are formed from Indium Tin Oxide (ITO). The electrodes 32 and 34 are formed by a conventional process, such as printing, vacuum deposition, sputtering or CVD, upon the exterior surfaces of the front and back plates 12 and 14. Alternately, the electrodes 32 and 34 can be deposited upon flat glass or plastic plates or flexible films that are then applied to exterior surfaces of the front and back plates 12 and 14 (not shown). The leads 21 and 22 are electrically connected to electrodes 32 and 34 by a conventional method. While the connection is shown at the lower portion of the display 30, the connection can be placed anywhere upon the surface electrodes 32 and 34.

The channel 16 is filed with mixture of ionizable noble gases. In the preferred embodiment, a mixture of Neon and Xenon gases is used with the Xenon content within the range of four to twenty percent and a preferred Xenon content of sixteen percent. Other ultra-violet emitting gases, such as nitrogen or other rare gases also can be used in place of Xenon. With a sufficient additive percentage of the minority gas, any Neon light generation is suppressed sufficiently that it is not noticeable.

A layer 36 of an ultra-violet light excited phosphor is deposited upon surface of the channel 16 by a conventional method, such as, for example, electophoresis. The color of light emitted by the display 30 is determined by the specific phosphor that is selected. Different phosphors can be used within the channel 16 to provide a variety of colors. Typical phosphor colors include red, blue, green and white. Because different phosphors emit different intensities of light, the depth of the channel 16 can be varied to balance the light output from the different phosphors. Thus, the channel 16 can be made deeper for weak color emitting phosphors, such as blue, and shallower for bright color emitting phosphors, such as green.

Figure 5:
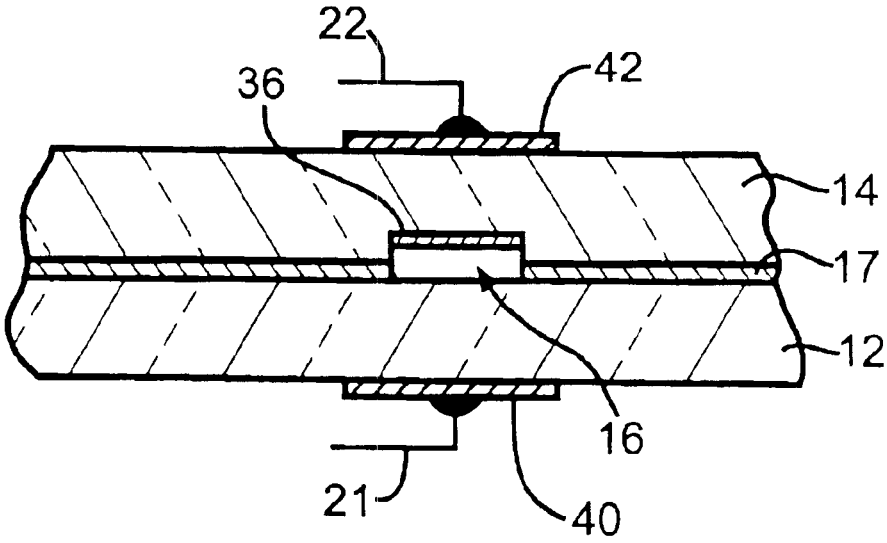
FIG. 5 is a fragmentary cross sectional view of an alternate embodiment of the invention taken along line 4—4 in FIG. 2.

An alternate embodiment of the display is illustrated in FIG. 5, where the electrodes 40 and 42 have the same shape as the indicia formed by the channel 16. Accordingly, the electrodes 40 and 42 do not extend over the entire surface of the front and back plates 12 and 14. The resulting reduction in size of the electrodes 40 and 42 reduces stray capacitance. As described above, leads 21 and 22 are electrically connected to the electrodes 40 and 42. Alternately, one of the electrodes, which can be upon the front or back, can have the same shape as the channel while the other electrode extends over the entire surface of the plate (not shown).

The operation of the display 30 will now be described. The leads 21 and 22 are connected to a conventional ac voltage supply 46, as shown in FIG. 2. The voltage supply 46 provides an alternating voltage to the electrodes that is sufficient to break down the gasses contained in the channel 16. The invention contemplates that the voltage will be in a relatively low range of one to three kilovolts and have a frequency in the range of one KHz to 100 KHz. As described above, typical positive column devices require a voltage in the range of six to nine kilovolts with a frequency that is between 15 and 50 KHz. The inventors have found that the brightness of the display 30 increases with an increase in frequency up to about 60 KHz. The brightness of the display also increases when the channel depth, gas pressure or voltage applied to the electrodes is increased.

The electrodes 32 and 34 do not contact the gasses contained within the channel 16, but are capacitively coupled through the plates 12 and 14 and across the gasses. The applied voltage excites the Xenon gas atoms causing the gas to emit ultra-violet light. The ultra-violet light impacts upon the phosphor layer 36 deposited within the channel 16. The ultra-violet light excites the atoms contained in the phosphor layer 36, causing the phosphor to emit visible light in a color that is a characteristic of the particular phosphor.

Because the voltage is applied across the channel 16, a displacement current flows transversely across the channel 16. Since only the depth of the channel 16 requires gas breakdown, the voltage required to operate the display 30 is greatly reduced from the voltage that would be required to operate an long positive column device, such as a conventional neon display, having an equivalent channel length. The current required increases with channel length while the voltage remains the same. However, a total discharge current of approximately 20 ma, which is equivalent to the current used by a typical neon sign, would not be reached for a display built in accordance with the invention until the channel length for the display exceeds 1500 inches. Thus, the discharge current used in a display built in accordance with the invention is less than the discharge current used in an equivalent positive column device, such as a neon sign. Accordingly, the reduced current and voltage requirements for a display in accordance with the invention results in a display power requirement that is significantly less than the power required by equivalent neon signage using a tube or flat channel. The inventors have determined that the heat generated by the display 30 is extremely low, usually being less than 50 milliwatts per channel inch. This compares favorably with an equivalent tube or flat channel neon device that has a typical value of at least 1.35 Watts per channel inch. Accordingly, the present invention provides greatly increased energy efficiency.

The invention also contemplates that the voltage source 46 includes a conventional energy recovery circuit. Otherwise, the displacement current resulting from the capacitive coupling of the electrodes 32 and 34 would be dissipated within the voltage supply 46, lowering the overall efficiency of the combined system of the display 30 and supply 46. Such energy recovery circuits are well known and used extensively in ac plasma display panels.

Some of the structural features of the invention may appear to be similar to those of an ac plasma display panel; however, due to the length of the channel 16, and the fact that the gas is excited along the entire channel length, the present invention is intended to operate at a much higher pressure gap product than a typical ac plasma display. The inventors have determined that the display 30 can be operated with a pressure gap product within a range of 5,000 to 200,000 torr-mils, with typical operation within a range of 5,000 to 100,000 torr-mils and preferred operation within a range of 5,000 to 75,000 torr-mils. Typical ac plasma displays operate with a pressure gap product of less than 2,400 torr-mils. Dissipation of electrical energy within the display 30 is much lower than that experienced at the lower pressure gap products of an ac plasma display. When compared to a conventional neon or color positive column display, the dissipated energy within the display 30 is about 30 times less using the present invention for comparable channel lengths.

Figure 6:
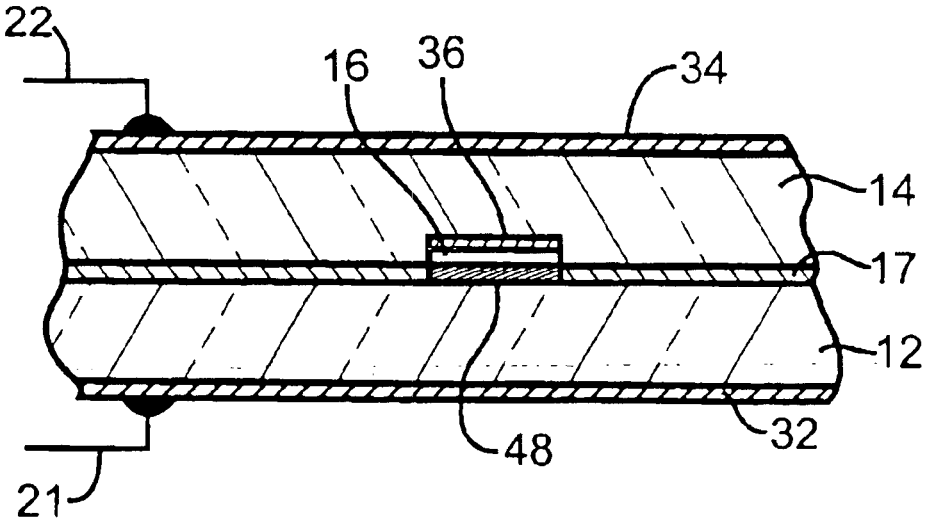
FIG. 6 is a fragmentary cross sectional view of another alternate embodiment of the invention taken along line 4—4 in FIG. 2.

In order to further reduce operating voltage, a surface coating layer 48, can be deposited upon the interior surface of the front plate 12 over the channel 16, as shown in FIG. 6. Magnesium Oxide or a rare earth oxide, such as, for example, Ytterbium Sesquioxide ($Yb_2O_3$), can be used to form the layer 48. The layer 48 is typically 100 to 900 nanometers thick and transparent to the light emitted from the phosphor 36 deposited within the channel 16. The layer 48 enhances secondary electron emissions within the discharge parameters, thereby improving the quantity of light emitted from, and the efficacy of, the display 30. Alternately, the surface coating layer can be applied over the entire inner surface of the front plate 12 (not shown).

Figure 7:
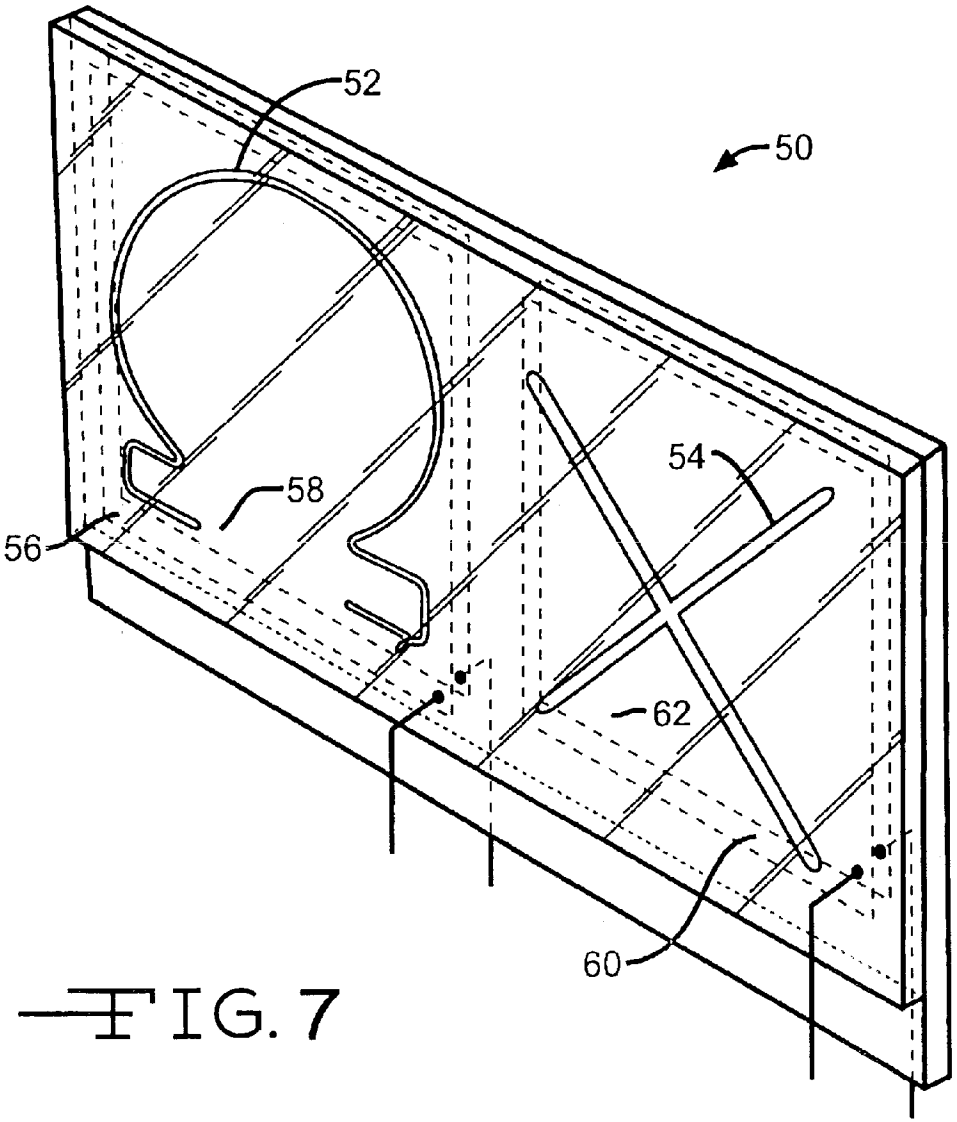
FIG. 7 is an isometric view of an alternate embodiment of the luminous gas discharge display shown in FIG. 2.

Another embodiment of the invention is illustrated in FIG. 7 where a display 50 is shown that has two indicia 52 and 54 formed therein. Each of the indicia 52 and 54 is provided with a pair of associated surface electrodes formed upon the exterior surfaces of the plates. A first electrode pair 56 and 58, enclosed by dashed lines, corresponds to the first indicia 52 and a second electrode pair 60 and 62, also enclosed by dashed lines, corresponds to the second indicia 54. As shown in FIG. 7, the first electrode pair 56 and 58 is electrically separated from the second electrode pair 60 and 62. Each of the electrode pairs is connected to a separate pair of leads for supplying a voltage to the electrodes. Accordingly, the indicia 52 and 54 can be illuminated independently of one another, providing for animation of the display 50.

Figure 8:
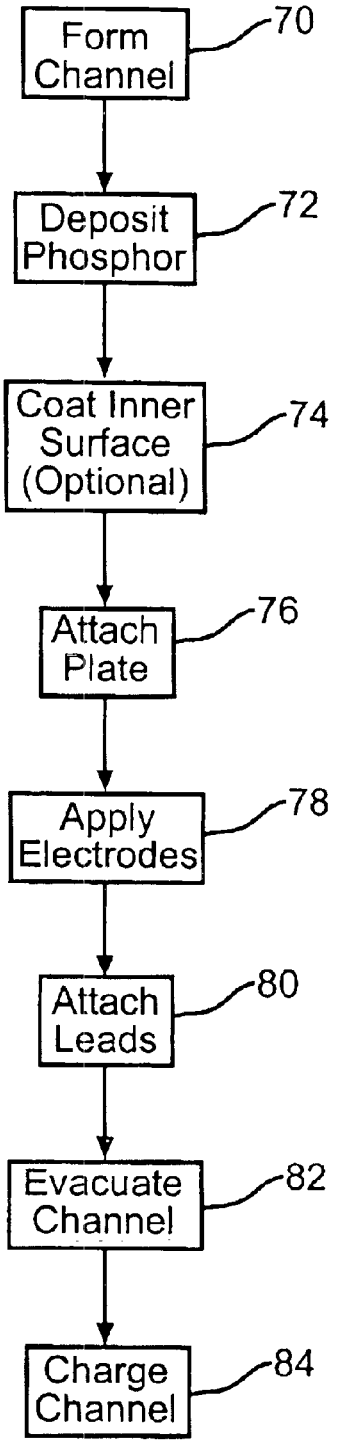
FIG. 8 is a flow chart for a method for fabricating the display shown in FIG. 2.

The invention also contemplates a method for producing a display that is illustrated by the flow chart shown in FIG. 8. In functional block 70, a channel is formed in a first plate by a conventional method, such as a chemical process or mechanical routing. In functional block 72, one or more phosphors are deposited within the channel. A surface coating is deposited upon a surface of a second plate, that is transparent, in functional block 74; however, this step is optional. The second plate is attached to the first plate in functional block 76 with the channel and any coating applied in functional block 74 between the plates. During the attachment, a seal is formed between the plates. Surface electrodes are applied to the exterior of both of the plates by a conventional process, such as printing, vacuum deposition, sputtering or CVD in functional block 78. Electrical leads are attached to the surface electrodes in functional block 80. In functional block 82, the channel is evacuated and then is charged with a mixture of noble gases in functional block 84.

It will be appreciated that the sequence of steps shown in FIG. 8 are exemplary and that the method can be practiced with a different sequence than shown. For example, the channel could be evacuated and charged before the electrodes are applied to the plates.

The invention further contemplates that larger displays can be assembled from a plurality of smaller segments that are mounted in a common manner and driven from a single voltage source or multiple voltage sources (not shown). Thus, the segments are usable for tiling with a plurality of independent displays mounted in a frame to produce a co-dependent image.

The invention also contemplates that the front surface of the display 30 may be decorated in any suitable manner to include application of opaque vinyl cut to allow passage of the light generated in the channel 16 (not shown). Alternately, inks may be utilized to print an opaque mask upon portions of the front surface of the display 30. Similarly, contrast enhancement filters may be placed over all or portions of the front surface of the display 30 when the display is placed in a brightly lit environment.

Figure 9:
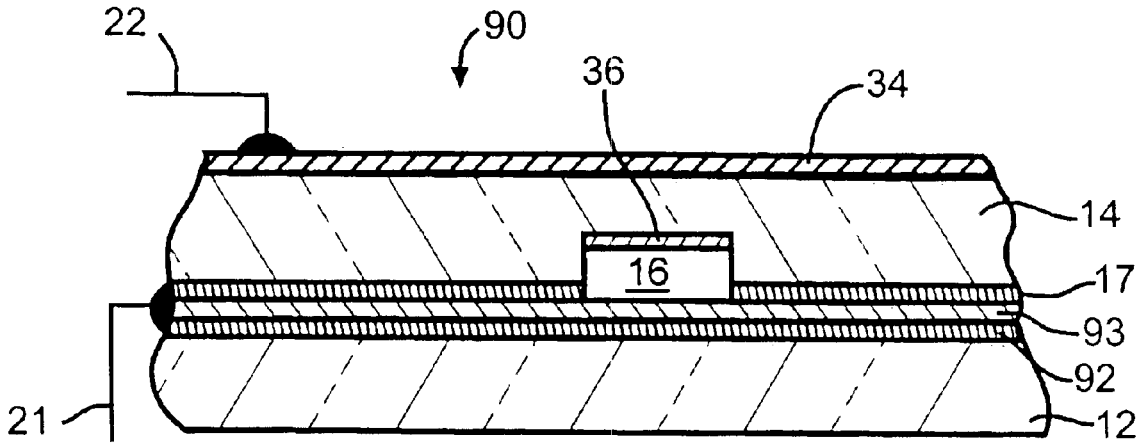
FIG. 9 is a fragmentary cross sectional view of another alternate embodiment of the invention taken along line 4—4 in FIG. 2.

Another embodiment of the invention is shown generally at 90 in FIG. 9. As before, components shown in FIG. 9 that are similar to components in the preceding figures have the same numerical designators. As shown in FIG. 9, the embodiment 90 includes a single internal electrode 92 formed on the inside surface of the front plate 12. The internal electrode 92 co-operates with the external electrode 34 formed upon the outside surface of back plate 14 to break down the gases contained in the channel 16. The electrode 92 extends to the edge of the display 90, where an electrical connection is made with the lead 21. In the preferred embodiment, a layer 93 of an oxide, such as, for example, Magnesium Oxide, or a rare earth oxide, such as, for example, Ytterbium Sesquioxide ($Yb_2O_3$), is deposited overt the electrode 92 to prevent contact between the electrode 92 and the gasses contained in the channel 16. The layer 93 is included to prevent any sputtering problems during operation of the display 90; however, it will be appreciated that the invention also can be practiced without the layer 93.

As shown in FIG. 9, the internal electrode 92 covers the entire inside surface of the front plate 12; however, it will be appreciated that the internal electrode also can be shaped in the same configuration as the channel 16 (not shown). When the internal electrode is limited to the shape of the channel 16, it is necessary to extend the corresponding lead to the electrode. The extension can involve passing the lead transversely through the front or back plate (not shown) or between the plates 12 and 14 from an edge of the display 90. Alternately, a narrow portion of the electrode can extend between the plates 12 and 14 from the channel 16 to the edge of the display 90 (not shown) where an electrical connection with the lead may be made.

Figure 10:
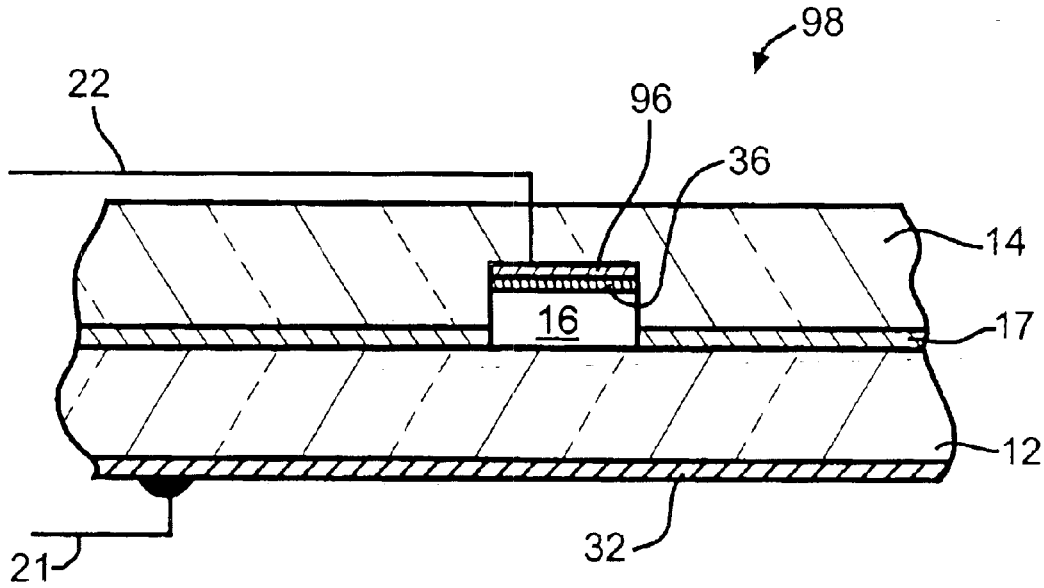
FIG. 10 is a fragmentary cross sectional view of another alternate embodiment of the invention taken along line 4—4 in FIG. 2.

Another embodiment utilizing an internal electrode 96 is shown generally at 98 in FIG. 10. Again, components shown in FIG. 10 that are similar to components in the preceding figures have the same numerical designators. The electrode 96 is deposited upon the base surface of the channel 16, beneath the phosphor layer 36. The lead 22 is extended through a portion of the back plate 14 and electrically connected to the electrode 96. Alternately, the lead can extend between the plates 12 and 14 from an edge of the display 98 (not shown), or a narrow portion of the electrode can extend between the plates 12 and 14 from the channel 16 to the edge of the display 98 (not shown) where an electrical connection with the lead may be made.

The inventors believe that a display having one internal and one external electrode will provide improved operating efficacies that are similar to the displays having two external electrodes as described above.

Figure 11:
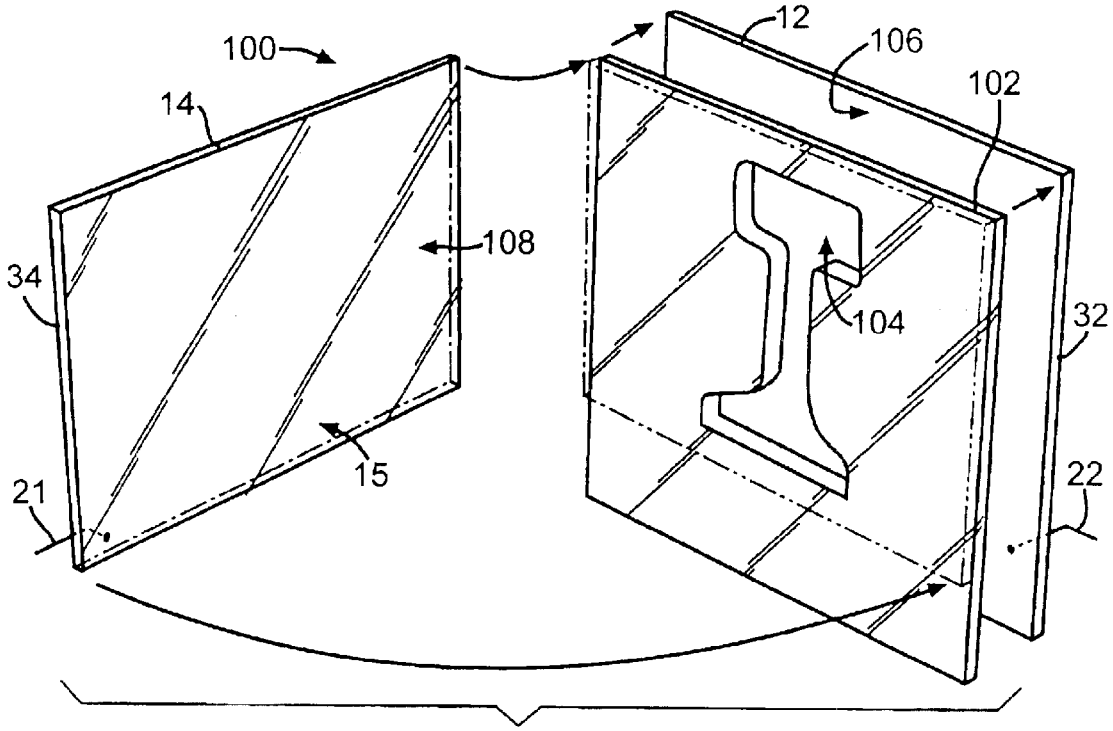
FIG. 11 is an exploded isometric view of another embodiment of the gas discharge display of FIG. 2.

It also is possible to practice the invention upon a display 100 as shown in FIG. 11 in which an intermediate plate 102 is disposed between the front and back plates 12 and 14. As before, components shown in FIG. 11 that are similar to components in the preceding figures have the same numerical designators. A geometric pattern is cut through the intermediate plate 102 to form a cavity 104 between the front and back plates 12 and 14 when the display 100 is assembled. While a cavity 104 having a geometric pattern is shown in FIG. 11, it will be appreciated that a channel (not shown) also can be cut through the plate 102 to form a indicia as shown in the preceding figures. A first layer 106 of sealing material forms a hermetic seal between the front plate 12 and the intermediate plate 102 while a second layer 108 of sealing material forms a hermetic seal between the back plate 14 and the intermediate plate 102. The sealing layers 106 and 108 can extend across the inner surface of the corresponding plate 12 and 14 or be formed as a perimeter seal. As before, a transparent first external electrode 32 is deposited upon the outer surface of the front plate 12 and a second external electrode 34 is deposited upon the outer surface of the back plate 14. A layer 16 of phosphor is deposited over the inner surface of the back plate 14. The cavity 104 is charged with a mixture of noble gases through a tube (not shown) that can extend through either the front or back plates 12 and 14 or through an edge of the intermediate plate 102. As described above, the display 100 also may be formed with one of the external electrodes 32 or 34 replaced by an internal electrode (not shown) that is disposed upon the inner surface of one of the front and back plates 12 and 14. As also described above, in the preferred embodiment, the internal electrode is covered by a layer of an oxide, such as, for example, Magnesium Oxide, or a rare earth oxide, such as, for example, Ytterbium Sesquioxide ($Yb_2O_3$)

Figure 12:
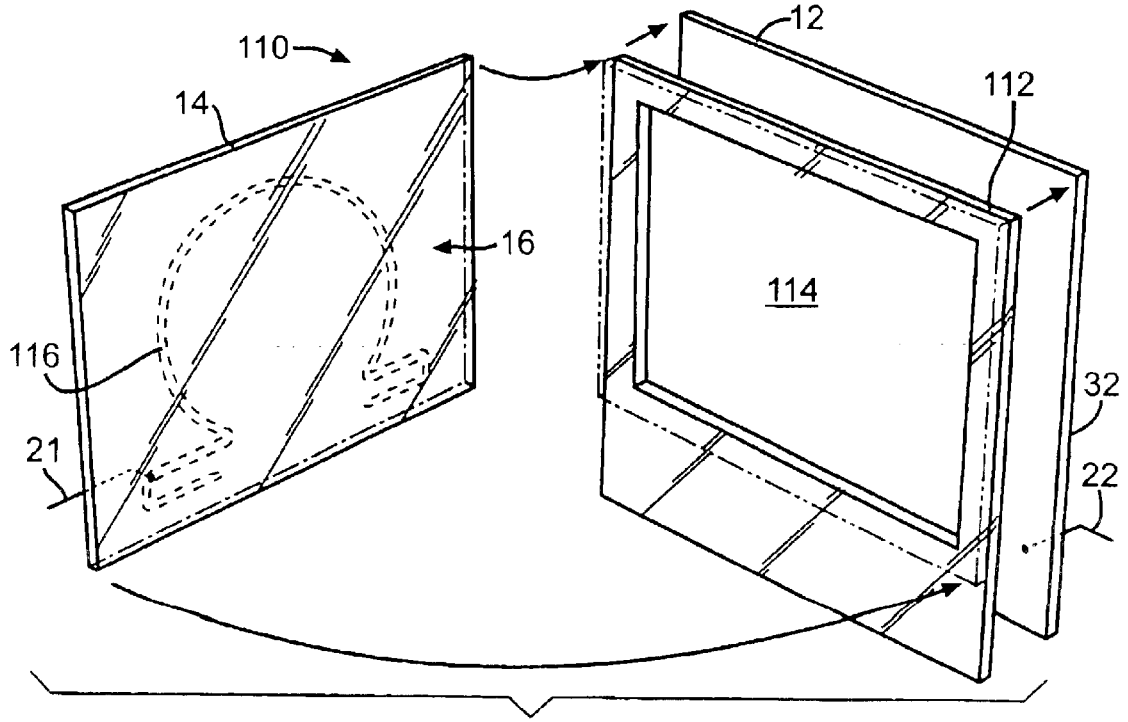
FIG. 12 is an exploded isometric view of another embodiment of the gas discharge display of FIG. 2.

Another embodiment of the display is illustrated generally at 110 in FIG. 12. In FIG. 12, an intermediate spacer member 112 is disposed between the front and back plates 12 and 14. Again, components shown in FIG. 12 that are similar to components in the preceding figures have the same numerical designators. The spacer member 112 is hermetically sealed by layers of sealing material to the front and back plates 12 and 14 and cooperates therewith to form a chamber 114 that is charged with a mixture of noble gases. As shown in FIG. 12, a transparent first external electrode 32 is deposited upon the outer surface of the front plate 32. A second electrode 116, which has the shape of an indicia is deposited upon the outer surface of the back plate 14. A layer 16 of phosphor is deposited over the inner surface of the back plate 14. Upon application of a voltage to the electrodes 32 and 116, the gases in the chamber 114 that are between the electrodes break down and emit ultra-violet light that, in turn, causes the phosphor layer 16 to emit visible light for the portion of the back plate 14 that covers the shaped electrode 116. The image can be enhanced by applying a mask (not shown) to the outer surface of the front plate by a conventional method, such as printing. The mask would include opaque parts to block emission of light. Additionally, white phosphor can be used for the phosphor layer 16 to assure bright illumination. As described above, the invention also can be practiced with an internal electrode formed upon an inner surface of one of the front or back plates 12 and 14.

The inventors have found that the present invention provides satisfactory illumination levels with the brightness being controlled by the channel depth and gas pressure. Typical initial illumination levels, which include the eye responses, are listed the following table for different phosphor colors.

| | |
|---|---|
| Green Phosphor | >3,500 candelas/$m^2$ |
| Red Phosphor | >3,000 candelas/$m^2$ |
| Blue Phosphor | >1,000 candelas/$m^2$ |

Prior art displays usually have included mercury vapor in the gas mixture within the illuminated channel to suppress sputtering of the electrodes. Because of the high pressure gap product utilized in the present invention and the elimination of direct contact between the gas mixture and the metal contained in the electrodes, sputtering of electrodes is not a problem. Accordingly, mercury is not required to be included in the gas mixture.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, both the front and back plates may be channeled in combination with one another or with a third intermediate plate to provide exotic light output combinations.

What is claimed is:

1. A light display comprising:

a first flat plate having an interior surface and an exterior surface;

a second flat plate that is formed seperately from said first plate and that has an interior surface and an exterior surface, said second plate attached to said first plate by a seal with said interior surfaces of said first and second plates facing one another;

a cavity formed between said first and second plates;

a layer of phosphor deposited upon an interior surface of one of said first and second plates;

at least one electrode formed upon an exterior surface of one of said first and second plates;

a second electrode formed upon a surface of the other of said first and second plates; and a gas mixture disposed within said cavity.

2. The light display according to claim 1 wherein said second electrode is formed upon an exterior surface of the other of said first and second plates.

3. The light display according to claim 2 wherein said cavity is formed in said internal surface of said first plate and said phosphor is deposited within said cavity.

4. The light display according to claim 3 wherein said cavity is a continuous groove.

5. The light display according to claim 3 wherein said sealing layer includes a layer of sealing material that is disposed between and contacts both said first and second plates to form a hermetic seal.

6. A light display comprising:

a first plate having an interior surface and an exterior surface;

a second plate having an interior surface and an exterior surface with said interior surface of second plate facing said interior surface of said second plate;

an intermediate member disposed between said first and second members with a first layer of sealing material disposed between said first plate and said intermediate member to form a hermetic seal therebetween and a second layer of sealing material disposed between said second plate and said intermediate member to form a hermetic seal therebetween;

a cavity formed between said first and second plates;

a layer of phosphor deposited upon an interior surface of one of said first and second plates;

a first electrode formed upon an exterior surface of said first plate;

a second electrode formed upon an exterior surface of said second plate; and a gas mixture disposed within said cavity.

7. The light display according to claim 6 wherein said cavity is formed in said intermediate member.

8. The light display according to claim 7 wherein said cavity is a continuous channel.

9. A light display comprising:

a first plate having an interior surface and an exterior surface;

a second plate having an interior surface and an exterior surface, said second plate attached to said first plate by a seal with said interior surfaces facing one another;

a cavity formed between said first and second plates;

a layer of phosphor deposited upon an interior surface of one of said first and second plates;

at least one electrode formed upon an exterior surface of one of said first and second plates;

a second electrode formed upon an interior surface of the other of said first and second plates; and a gas mixture disposed within said cavity.

10. The light display according to claim 2 wherein at least one of said first and second plates is transparent.

11. The light display according to claim 2 wherein said gas mixture includes noble gases whereby mercury is excluded from said cavity.

12. The light display according to claim 11 wherein said gas mixture includes Neon and Xenon gases.

13. The light display according to claim 12 wherein the Xenon content of said gas mixture is within the range of four to twenty percent.

14. The light display according to claim 13 wherein the Xenon content of said gas mixture is 16 percent.

15. The light display according to claim 11 further including an alternating voltage power supply that is connected to said electrodes.

16. The light display according to claim 15 wherein said power supply provides a voltage within a range of one to three kilovolts and having a frequency within a range of 15 to 50 kilohertz.

17. The light display according to claim 15 further including a transparent layer of a rare earth oxide deposited directly upon an interior surface of one of said first and second plates.

18. The light display according to claim 17 wherein said rare earth oxide is Ytterbium Sesquioxide.

19. The light display according to claim 15 further including a transparent layer of magnesium oxide deposited directly upon said interior surface of one of said first and second plates.

20. The light display according to claim 11 wherein said gas mixture within said cavity is pressurized to provide a pressure gap product that is within a range of 5,000 to 200,000 torr-mils.

21. A method for forming a light display comprising the steps of:

(a) providing a first plate;

(b) forming a cavity in a surface of the first plate;

(c) depositing a phosphor within the cavity;

(d) attaching a second plate to the first plate with the cavity located between the first and second plates;

(e) applying a first surface electrode to an exterior surface of the first plate;

(f) applying a second surface electrode to a surface of the second plate;

(g) evacuating the cavity; and (h) charging the cavity with a mixture of noble gases.

22. The method according to claim 21 further including, between steps (f) and (g), electrically attaching a lead to each of the electrodes.

23. The method according to claim 22 wherein during step (f) the second electrode is applied to an exterior surface of the second plate.

24. The method according to claim 22 wherein during step (f) the second electrode is applied to an interior surface of the second plate.

25. The method according to claim 23 wherein a hermetic seal is formed between the first and second plates during step (d).

26. The method according to claim 25 wherein the gas mixture used to charge the channel in step (h) includes a mixture of Neon and Xenon gases with the Xenon content of the gas mixture being within the range of four to twenty percent.

27. A method for forming a light display comprising the steps of:

(a) providing an intermediate plate;

(b) forming a continuous channel in the intermediate plate;

(c) attaching the intermediate plate to a first plate;

(d) depositing a phosphor within the channel;

(e) applying a first surface electrode to an exterior surface of the first plate;

(f) applying a second surface electrode to a surface of a third plate;

(g) attaching the third plate to the intermediate plate with the intermediate plate located between the first and third plates;

(h) evacuating the channel; and (i) charging the channel with a mixture of noble gases.

28. The method according to claim 27 wherein during step (f) the second electrode is applied to an exterior surface of the third plate.

29. The method according to claim 27 wherein during step (f) the second electrode is applied to an interior surface of the third plate.

* * * * *